US010199768B2

(12) United States Patent
Nagasaki

(10) Patent No.: US 10,199,768 B2
(45) Date of Patent: Feb. 5, 2019

(54) CONNECTOR

(71) Applicant: Tyco Electronics Japan G.K., Kanagawa (JP)

(72) Inventor: Taisuke Nagasaki, Kanagawa (JP)

(73) Assignee: Tyco Electronics Japan G.K., Kanagawa (JP)

( * ) Notice: Subject to any disclaimer, the term of this patent is extended or adjusted under 35 U.S.C. 154(b) by 0 days.

(21) Appl. No.: 15/609,643

(22) Filed: May 31, 2017

(65) Prior Publication Data

US 2017/0352981 A1 Dec. 7, 2017

(30) Foreign Application Priority Data

Jun. 2, 2016 (JP) ..... 2016-110733

(51) Int. Cl.

| | |
|---|---|
| ***H01R 13/627*** | (2006.01) |
| *H01R 24/20* | (2011.01) |
| *H01R 24/86* | (2011.01) |
| *H01R 107/00* | (2006.01) |

(52) U.S. Cl.

CPC ..... *H01R 13/6273* (2013.01); *H01R 13/6275* (2013.01); *H01R 24/20* (2013.01); *H01R 24/86* (2013.01); *H01R 2107/00* (2013.01); *H01R 2201/10* (2013.01)

(58) Field of Classification Search

CPC ..... H01R 13/6272; H01R 13/6273; H01R 13/6275; H01R 13/641; H01R 13/639; H01R 13/506; H01R 23/025

USPC ..... 439/353, 354, 357, 358

See application file for complete search history.

(56) References Cited

U.S. PATENT DOCUMENTS

| | | | | |
|---|---|---|---|---|
| 4,316,647 A * | 2/1982 | Bailey | H01R 13/627 | 439/354 |
| 4,621,885 A * | 11/1986 | Szczesny | H01R 12/675 | 439/357 |
| 4,735,583 A * | 4/1988 | Rudy, Jr. | H01R 13/518 | 439/350 |
| 5,234,357 A * | 8/1993 | Yamaguchi | H01R 13/639 | 439/354 |
| 6,817,887 B2 * | 11/2004 | Jones | H01R 13/6275 | 439/405 |
| 7,083,459 B1 * | 8/2006 | Wu | H01R 13/6275 | 439/354 |

(Continued)

FOREIGN PATENT DOCUMENTS

| | | |
|---|---|---|
| JP | 2009289644 A | 12/2009 |
| JP | 2011249230 A | 12/2011 |
| JP | 201648654 A | 4/2016 |

OTHER PUBLICATIONS

Abstract of JP2009289644, dated Dec. 10, 2009, 2 pages.
Abstract of JP2016048654, dated Apr. 7, 2016, 2 pages.
Abstract of JP2011249230, dated Dec. 8, 2011, 2 pages.

*Primary Examiner* — Hien Vu
(74) *Attorney, Agent, or Firm* — Barley Snyder

(57) ABSTRACT

A connector comprises a housing and a lock connected to the housing. The lock has a base extending in a mating direction, a bend extending continuously from a rear end of the base in the mating direction and formed in a U-shape, and a press-fitting protrusion extending from an end of the bend opposite the base. The bend has a bend face facing in the mating direction and is separated from the housing by a bend gap. The press-fitting protrusion is press-fitted in the housing.

13 Claims, 13 Drawing Sheets

(56) References Cited

U.S. PATENT DOCUMENTS 9,748,677 B2 * 8/2017 Urano ..... H01R 12/57

* cited by examiner

CONNECTOR

CROSS-REFERENCE TO RELATED APPLICATION

This application claims the benefit of the filing date under 35 U.S.C. § 119(a)-(d) of Japanese Patent Application No. 2016-110733, filed on Jun. 2, 2016.

FIELD OF THE INVENTION

The present invention relates to a connector and, more particularly, to a connector having a lock.

BACKGROUND

An electrical connector for a motor which receives power supplied to the motor is known. A connector connected to a cable is mated with a mating connector of the motor and power is supplied to the motor via the cable. In such a connector structure, a lock prevents the connector and the mating connector from being easily disengaged.

Japanese Patent Application No. 2016-48654A discloses such a connector connected with a cable for power supply to a motor. The connector has a pair of locks disposed on both sides of a housing in rightward and leftward directions perpendicular to a mating direction for engaging with a mating connector and a lock support movable in frontward and rearward directions perpendicular to the mating direction. The lock support moves between the locks and the housing to support the locks. In addition, the lock support creates a gap between the locks and the housing such that the locks can be deflected. The connector has a low profile as compared with a known connector having a bayonet lock.

The connector of Japanese Patent Application No. 2016-48654A completes mating by a single action of pressing the connector against the mating connector installed in the motor. However, detaching the connector from the mating connector requires two actions of moving the lock support and then pulling the connector from the mating connector, which requires holding the connector in a different posture.

SUMMARY

An object of the invention, among others, is to provide a low-profile connector capable of mating with a mating connector by a single action and detaching from the mating connector by a single action. A connector according to the invention comprises a housing and a lock connected to the housing. The lock has a base extending in a mating direction, a bend extending continuously from a rear end of the base in the mating direction and formed in a U-shape, and a press-fitting protrusion extending from an end of the bend opposite the base. The bend has a bend face facing in the mating direction and is separated from the housing by a bend gap. The press-fitting protrusion is press-fitted in the housing.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
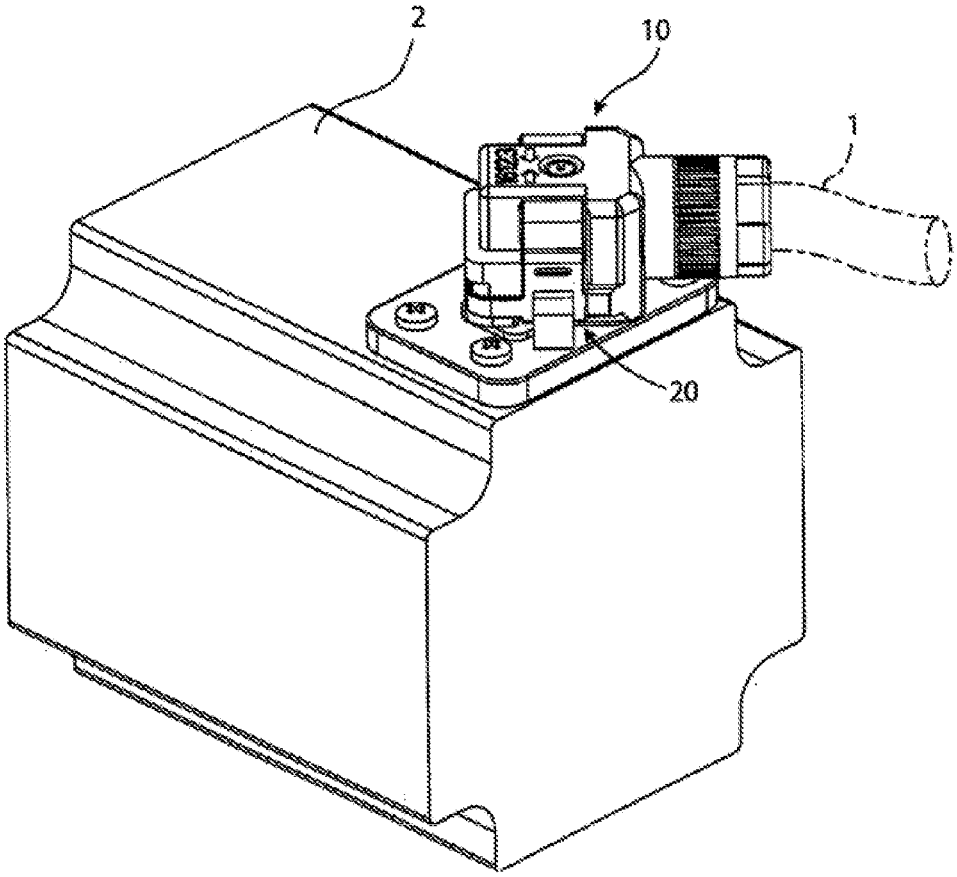
FIG. 1 is a perspective view of a connector and a mating connector according to the invention on a motor.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

Figure 2:
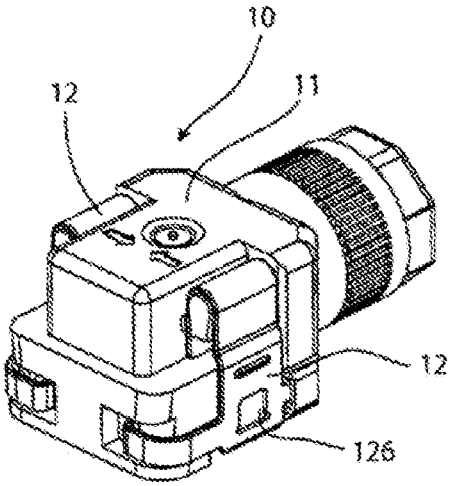
FIG. 2A is a perspective view of the connector.
FIG. 2B is a perspective view of the mating connector.
Figure 2:
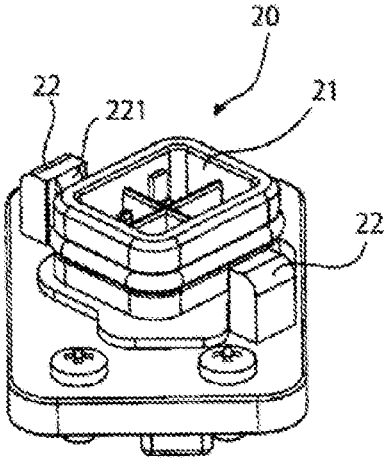
Figure 3:
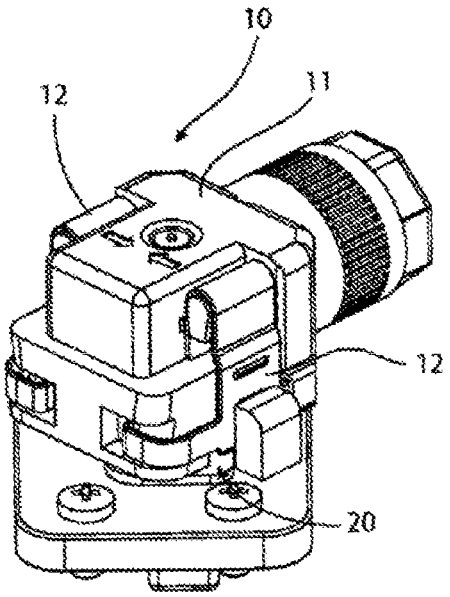
FIG. 3 is a perspective view of the connector and the mating connector in a mating state.

A connector assembly according to the invention is shown generally in FIGS. 1-3. The connector assembly includes a connector 10 and a mating connector 20. The major components of the invention will now be described in greater detail.

Figure 4:
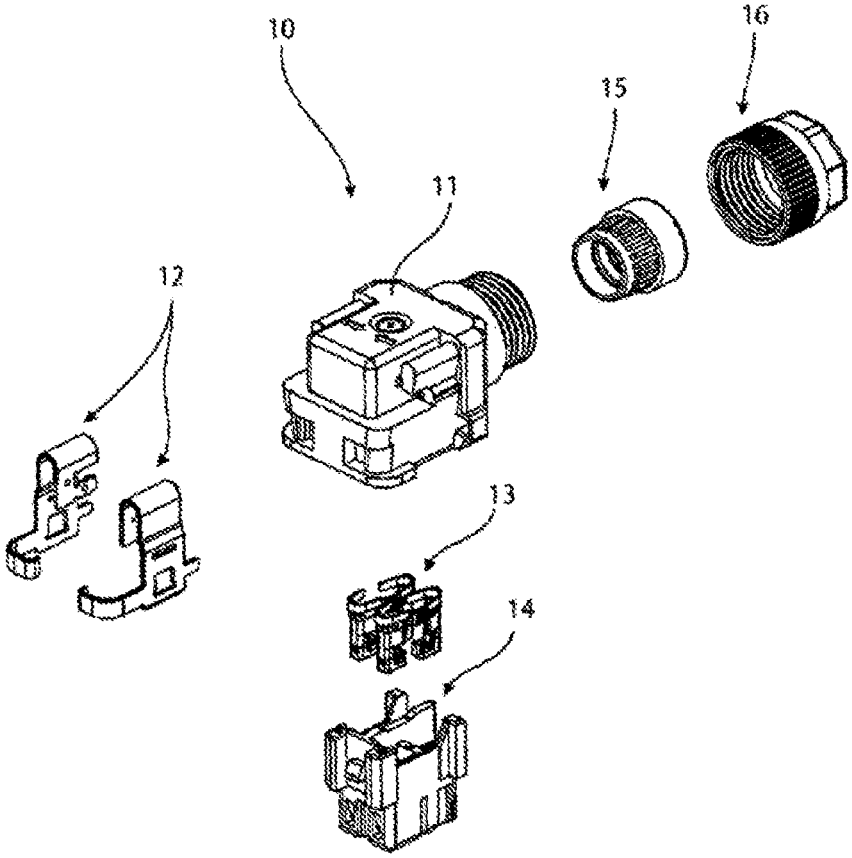
FIG. 4 is an exploded perspective view of the connector.
Figure 5:
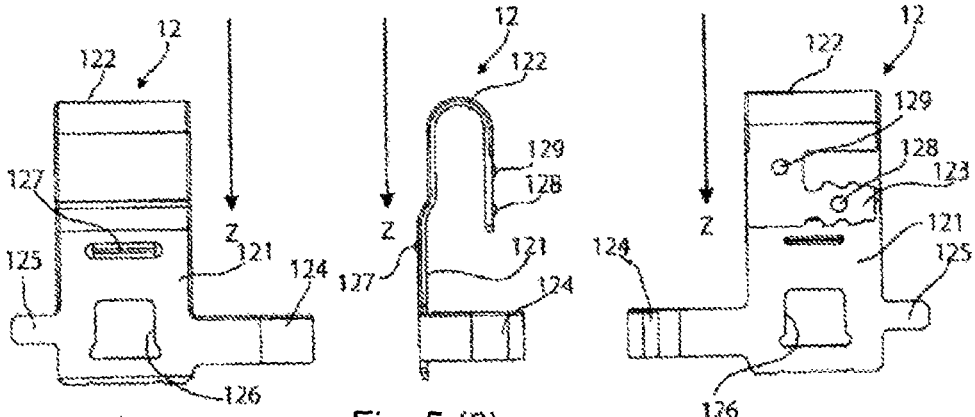
FIG. 5A is a side view of an outer face of a lock of the connector.
FIG. 5B is a side view of an end of the lock.
FIG. 5C is a side view of an inner face of the lock.
Figure 6:
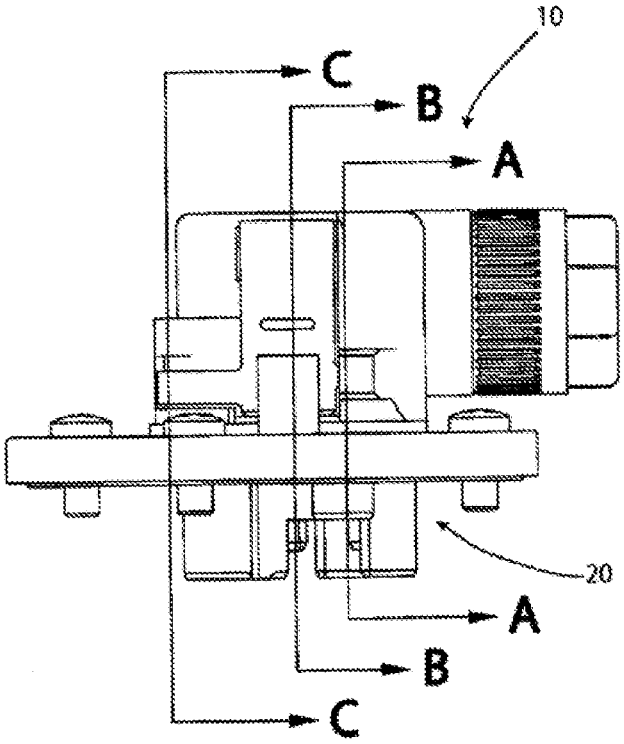
FIG. 6 is a side view of the connector and the mating connector in the mating state.

The connector 10 is shown in FIGS. 2A, 4, and 5. As shown in FIG. 4, the connector 10 has an outer housing 11, locks 12, contacts 13, an inner housing 14, a rubber bushing 15, and a screw housing 16.

Each lock 12, as shown in FIG. 2A, is disposed on a right or a left side of the outer housing 11. Each lock 12 is integrally formed as a resilient leaf spring. The lock 12 has an outer face shown in FIG. 5A, an end shown in FIG. 5B, and an inner face shown in FIG. 5C. When the lock 12 is disposed on the outer housing 11, the outer face of the lock 12 faces away from the outer housing 11 and the inner face of the lock 12 faces toward the outer housing 11.

The lock 12, as shown in FIGS. 5A-5C, includes a base 121, a bend 122, a press-fitting protrusion 123, a first arm 124, a second arm 125, and an engaging hole 126. A portion of the lock 12 where the engaging hole 126 is formed is disposed at a deflection distance from a wall face of the outer housing 11 so as to be capable of inward deflection.

The base 121 of the connector 10, as shown in FIGS. 5A-5C, extends in a mating direction Z to the mating connector 20 and the engaging hole 126 is formed in a lower part of the base 121. A projection 127 projecting away from the base 121 in a thickness direction is disposed above the engaging hole 126. The base 121 is disposed in a position located outside the outer housing 11 and, as described above, is disposed at a deflection distance from an outer wall face of the outer housing 11. The base 121 can be deflected toward the outer wall face of the outer housing 11.

The bend 122, as shown in FIGS. 5A-5C, is a portion that is continuous at a rear end in the mating direction Z of the base 121, namely, an upper portion of the base 121 formed in an approximate U-shape.

Figure 11:
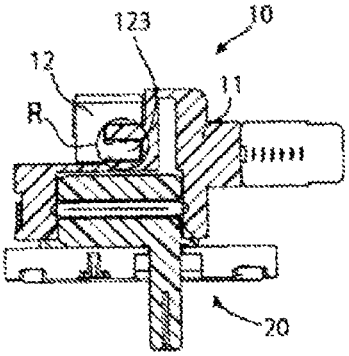
FIG. 11A is a sectional view of the connector and the mating connector taken along line G-G in FIG. 10.
FIG. 11B is an enlarged portion of FIG. 11A.
Figure 11:
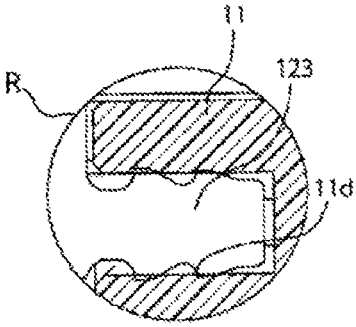

The press-fitting protrusion 123, as shown in FIG. 5A-5C, is continuous from an end of the bend 122 opposite the base 121 and extends in the mating direction Z. An end face of the press-fitting protrusion 123, as shown in FIGS. 11A and 11B, is formed with serration-like teeth and notches. When the press-fitting protrusion 123 is press-fitted into a press-fitting hole 11*d* of the outer housing 11, the teeth of the serration-like teeth and notches frictionally engage an inner wall of the press-fitting hole 11*d* of the outer housing 11 so that the lock 12 is fixed to the outer housing 11 with a predetermined strength.

Figure 12:
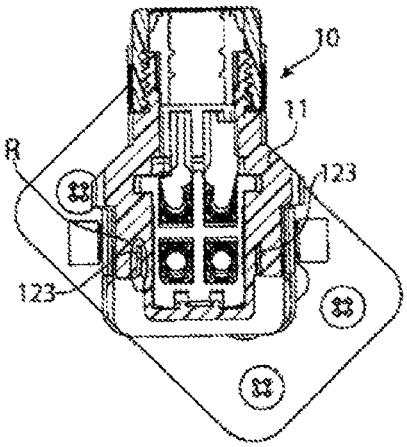
FIG. 12A is a sectional view of the connector and the mating connector taken along line H-H in FIG. 10.
FIG. 12B is an enlarged portion of FIG. 12A.
Figure 12:
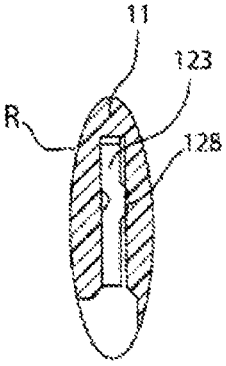

The press-fitting protrusion 123 has a first bulge 128, as shown in FIGS. 5B and 5C, extending in a thickness direction of the lock 12. In the shown embodiment, the first bulge 128 is formed by pressing a rear face of the press-fitting protrusion 123. As shown in FIGS. 12A and 12B, the first bulge 128 interferes with the outer housing 11 such that the first bulge 128 frictionally engages the outer housing 11. By this interference, the first bulge 128 reinforces the robustness of press-fitting of the serrated end face of the press-fitting protrusion 123.

Figure 13:
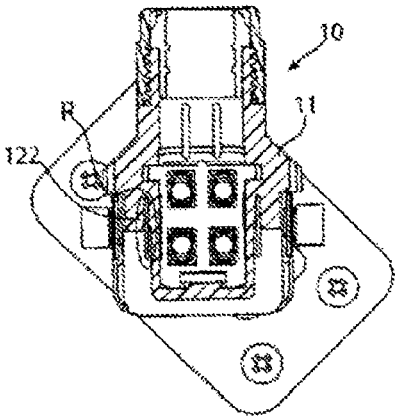
FIG. 13A is a sectional view of the connector and the mating connector taken along line J-J in FIG. 10.
FIG. 13B is an enlarged portion of FIG. 13A.
Figure 13:
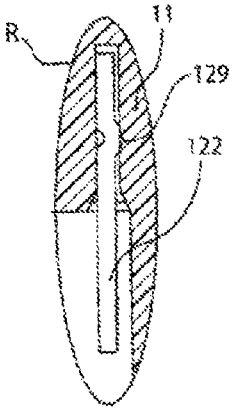

A second bulge 129 extending in a thickness direction of the lock 12 is formed on the bend 122, as shown in FIGS. 5B and 5C. The second bulge 129, as shown in FIGS. 13A and 13B, similarly frictionally engages the outer housing 11 to hold the lock 12 on the outer housing 11.

The first arm 124 and the second arm 125, as shown in FIGS. 5A-5C, extend frontward and rearward, respectively, from a leading end in the mating direction Z of the base 121 in directions perpendicular to the mating direction Z. The first arm 124 extending frontward has a distal end curved so as to wrap a part of the outer housing 11. The second arm 125 extending rearward is inserted into the outer housing 11.

The mating connector 20, as shown in FIG. 2B, has a pair of hooks 22, each hook 22 positioned at a right or a left side of a mating portion 21. These hooks 22 have catches 221 projecting inward.

As shown in FIGS. 2 and 3, when the connector 10 is mated with the mating connector 20, the locks 12 of the connector 10 are pushed by the catches 221 of the hooks 22 of the mating connector 20 and deflected toward the outer housing 11. Then, when the mating proceeds to a position where the catches 221 coincide with the engaging holes 126, the locks 12 are restored to their original states from their deflected states, and the catches 221 are positioned in the engaging holes 126. Thereby, the connector 10 and the mating connector 20 are locked together so that they are not unintentionally disengaged. The connector 10 mates with the mating connector 20 by a single action of pressing the connector 10 against the mating connector 20.

The connector 10 is shown in a fitted state with the mating connector 20 in FIGS. 6-9. In each of FIGS. 7-9, view (B) shows a state in which an unintentional force applied to the connector 10 in a disengaging direction from the mating connector 20 is not applied, and view (C) shows a state in which the unintentional force is applied.

Figure 7:
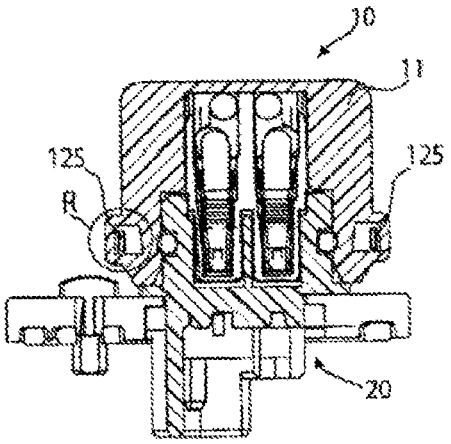
FIG. 7A is a sectional view of the connector and the mating connector taken along line A-A in FIG. 6.
FIG. 7B is an enlarged portion of FIG. 7A in a state in which an unintentional force is not applied.
FIG. 7C is an enlarged portion of FIG. 7A in a state in which the unintentional force is applied.
Figure 7B:
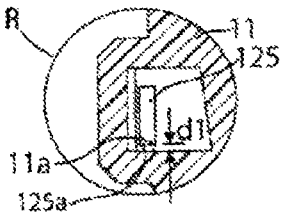
Figure 7C:
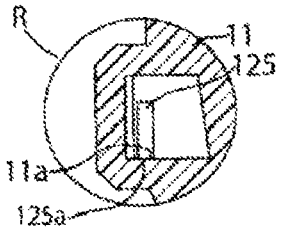
Figure 8:
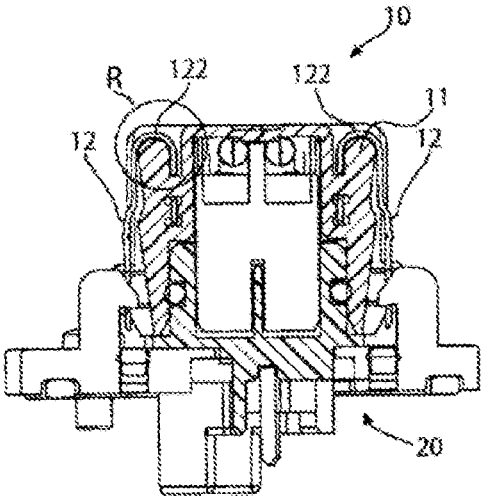
FIG. 8A is a sectional view of the connector and the mating connector taken along line B-B in FIG. 6.
FIG. 8B is an enlarged portion of FIG. 8A in a state in which an unintentional force is not applied.
FIG. 8C is an enlarged portion of FIG. 8A in a state in which the unintentional force is applied.
Figure 8:
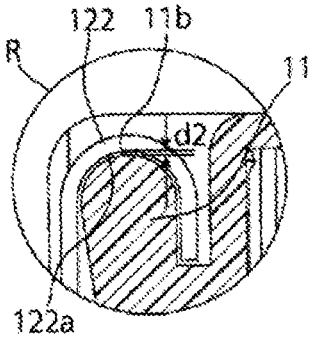
Figure 8:
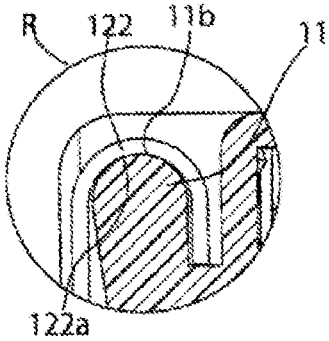

The second arm 125 is inserted in the outer housing 11 as shown in FIGS. 7A-7C. A downward second end face 125*a* of the second arm 125 is separated from an opposite face 11*a* of the outer housing 11, as shown in FIG. 7(B), when unintentional force is not applied. Therefore, a second arm gap d1 is formed between the second end face 125*a* and the opposite face 11*a*. When unintentional force in a direction of lifting the connector 10 is applied, the outer housing 11 is slightly lifted. However, since the lock 12 catches the hook portion 22 of the mating connector 20, as shown in FIG. 2, the lock 12 is less lifted than the outer housing 11 and is pulled downward. Under the unintentional force, as shown in FIG. 7C, opposite face 11*a* of the outer housing 11 abuts onto the downward second end face 125*a* of the second arm 125, and any further lifting of the outer housing 11 is blocked.

A downward bend face 122*a* of the bend 122, as shown in FIG. 8B, is separated from an opposite face 11*b* of the outer housing 11 and a bend gap d2 is formed therebetween when unintentional force is not applied. Then, when the outer housing 11 of the connector 10 is lifted by application of unintentional force, as shown in FIG. 8C, the opposite face 11*b* of the outer housing 11 abuts onto the downward face 122*a* of the bend 122, preventing the unintentional force from being transmitted to the press-fitting protrusion 123. If the unintentional force were transmitted to the press-fitting protrusion 123 of the lock 12, a portion of the outer housing 11 press-fitted with the press-fitting protrusion 123 would be contacted by the press-fitting protrusion 123, and contact between the contacts of the connector 10 and the mating connector 20 may become unstable. The connector 10 has a high lock strength achieved by the abutment of the opposite face 11*b* of the outer housing 11 onto the bend 122. The second bulge 129 also contributes to preventing the unintentional force from being transmitted to the press-fitting protrusion 123.

Figure 9:
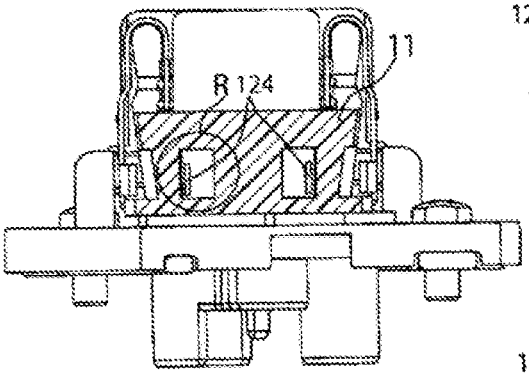
FIG. 9A is a sectional view of the connector and the mating connector taken along line C-C in FIG. 6.
FIG. 9B is an enlarged portion of FIG. 9A in a state in which an unintentional force is not applied.
FIG. 9C is an enlarged portion of FIG. 9A in a state in which the unintentional force is applied.
Figure 9B:
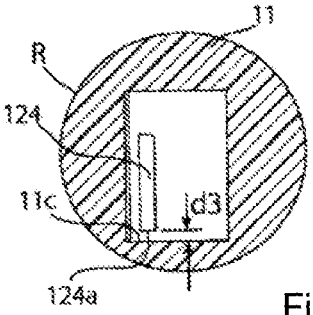
Figure 9C:
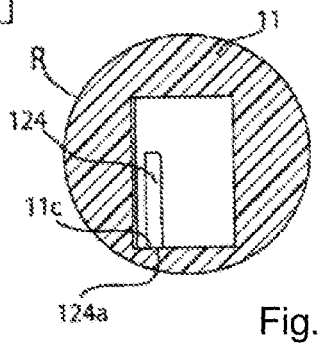
Figure 10:
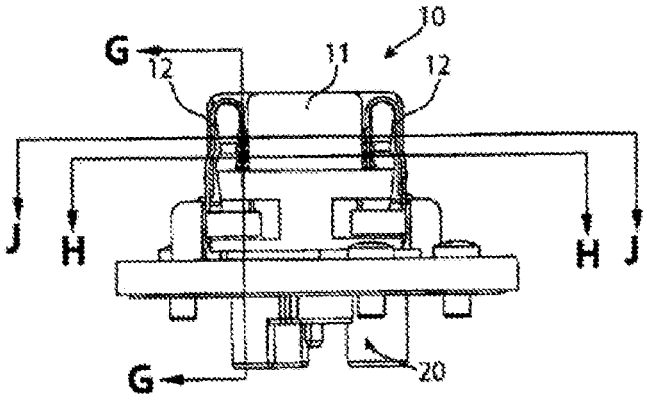
FIG. 10 is a front view of the connector and the mating connector in the mating state.

A downward first end face 124*a* of the first arm 124, shown in FIGS. 9A-9C, is separated from an opposite face 11*c* of the outer housing 11, as shown in FIG. 9(B), when unintentional force is not applied, forming a first arm gap d3 between the first end face 124*a* and the opposite face 11*c*. Then, when the outer housing 11 is slightly lifted by application of unintentional force in a direction of lifting the connector 10, the opposite face 11*c* of the outer housing 11 abuts onto the downward first end face 124*a* of the first arm 124, and any further lifting of the outer housing 11 is blocked.

The connector 10 secures the resiliency of the lock 12 since the base 121, the bend 122, the first arm 124, and the second arm 125, excluding the press-fitting protrusion 123, are not directly secured to the outer housing 11. Further, when unintentional force is applied, the force is distributed to and received by each of the locks 12 according to the direction of the moment or the strength of the force. By distributing and receiving the force in this manner, the breakage of the outer housing 11 is prevented.

When the connector 10 in the mating state shown in FIGS. 3 and 6-13 is extracted from the mating connector 20, the connector 10 is pulled upward while an operator pinches the locks 12 on both the right and left sides. The projection 127 informs an operator of the position of the lock 12 by feel when the operator pinches the locks 12 from the right and left. When the locks 12 are held in such a pinching manner, the locks 12 are deflected toward the wall faces of the outer housing 11, and then the catches 221 of the hooks 22 are disengaged from the engaging holes 126 of the locks 12. The connector 10 can be extracted from the mating connector 20 by a single action of pulling the connector 10 upward with the locks 12 pinched from both the right and left sides.

In an application shown in FIG. 1, the mating connector 20 is installed in a motor 2 such as a servomotor. The connector 10 is connected with one end of a cable 1. The motor 2 is supplied with power coming through the cable 1 via the connector 10 and the mating connector 20. The abutment of the second arm 125 with the outer housing 11 shown in FIG. 7C is particularly effective when a moment in a direction of lifting up the cable 1 acts on the connector 10. Further, the abutment between the first arm 124 and the outer housing 11 shown in FIG. 9C is particularly effective when a moment in a direction of pressing down the cable 1 acts on the connector 10.

The application of FIG. 1 is shown by way of example. The connector 10 and mating connector 20 of the present invention are widely applicable to any application required to perform mating by a single action and perform detachment by a single action.

What is claimed is:

1. An electrical connector, comprising:

a housing; and a lock connected to a side of the housing and having:

a first arm with a first end face spaced from the housing by a first arm gap and a second arm with a second end face spaced from the housing by a second arm gap, a base extending in a mating direction and the first arm extending from a leading end of the base in a first direction and the second arm extending from the leading end of the base in an opposite second direction, a bend extending continuously from a rear end of the base in the mating direction and formed in a U-shape, the bend having a bend face facing in the mating direction and spaced from the housing by a bend gap, and a press-fitting protrusion extending from an end of the bend opposite the base and press-fitted in the housing.

2. The electrical connector of claim 1, wherein the electrical connector is matable with a mating connector in the mating direction.

3. The electrical connector of claim 2, wherein the lock locks the electrical connector to the mating connector.

4. The electrical connector of claim 3, wherein the lock is integrally formed as a resilient leaf spring.

5. The electrical connector of claim 4, wherein, when the electrical connector receives a force in a direction of extraction opposite the mating direction, the bend gap is eliminated and the bend face abuts the housing.

6. The electrical connector of claim 1, wherein the press-fitting protrusion has a first bulge extending in a thickness direction of the lock and frictionally engaged with the housing.

7. The electrical connector of claim 6, wherein the bend has a second bulge extending in a thickness direction of the lock and frictionally engaged with the housing.

8. The electrical connector of claim 1, wherein, when the electrical connector receives a force in a direction of extraction opposite the mating direction, the first arm gap and the second arm gap are eliminated and the first end face and the second end face abut the housing.

9. The electrical connector of claim 3, wherein the electrical connector is matable with the mating connector by a first single action of pressing the electrical connector against the mating connector.

10. The electrical connector of claim 9, wherein the lock has an engaging hole disposed in the base, the engaging hole engaging a catch of the mating connector.

11. The electrical connector of claim 10, wherein the base is disposed at a deflection distance from the housing.

12. The electrical connector of claim 11, wherein the base is deflected toward the housing and the connector is moved in a direction opposite to the mating direction to extract the connector from the mating connector.

13. The electrical connector of claim 12, wherein the electrical connector is extractable from the mating connector by a second single action of moving the connector in the direction opposite the mating direction with the lock deflected toward the housing.

* * * * *